US007010836B2

(12) United States Patent
Acton et al.

(10) Patent No.: US 7,010,836 B2
(45) Date of Patent: Mar. 14, 2006

(54) WEB ADJUSTER DEVICE

(75) Inventors: Aaron J. Acton, Whitestown, IN (US); W. Patrick Beck, Indianapolis, IN (US)

(73) Assignee: Indiana Mills & Manufacturing, Inc., Westfield, IN (US)

( * ) Notice: Subject to any disclaimer, the term of this patent is extended or adjusted under 35 U.S.C. 154(b) by 15 days.

(21) Appl. No.: 10/780,164

(22) Filed: Feb. 17, 2004

(65) Prior Publication Data

US 2004/0158955 A1 Aug. 19, 2004

Related U.S. Application Data

(60) Provisional application No. 60/448,047, filed on Feb. 17, 2003.

(51) Int. Cl.
*A44B 11/25* (2006.01)

(52) U.S. Cl. ..... 24/265 BC; 24/170; 24/197

(58) Field of Classification Search ..... 24/170, 24/171, 196
See application file for complete search history.

(56) References Cited

U.S. PATENT DOCUMENTS

| | | | | |
|---|---|---|---|---|
| 2,919,481 A | | 1/1960 | Finken et al. | |
| 2,938,254 A | | 5/1960 | Gaylord | |
| 2,998,625 A | * | 9/1961 | Huber | 24/193 |
| 3,189,963 A | * | 6/1965 | Warner et al. | 24/196 |
| 3,274,656 A | * | 9/1966 | Hamann | 24/196 |
| 3,289,261 A | * | 12/1966 | Davis | 24/193 |
| 3,293,713 A | | 12/1966 | Gaylord | |
| 3,365,756 A | * | 1/1968 | Bayon | 24/196 |
| 3,369,057 A | * | 2/1968 | Twilley | 524/87 |
| 3,414,947 A | | 12/1968 | Holmberg et al. | |
| 3,460,336 A | * | 8/1969 | Demas et al. | 57/245 |
| 3,898,715 A | | 8/1975 | Balder | |
| 3,974,546 A | * | 8/1976 | Walker | 24/196 |
| 4,148,224 A | * | 4/1979 | Craig | 24/191 |
| 4,184,234 A | * | 1/1980 | Anthony et al. | 24/171 |
| 4,876,770 A | | 10/1989 | Bougher | |
| 5,058,244 A | * | 10/1991 | Fernandez | 24/170 |
| 5,311,653 A | | 5/1994 | Merrick | |
| 5,774,947 A | * | 7/1998 | Anscher | 24/171 |
| 5,806,148 A | * | 9/1998 | McFalls et al. | 24/171 |

FOREIGN PATENT DOCUMENTS

| | | |
|---|---|---|
| AU | 0 552 300 | 5/1985 |
| CH | 674 302 A5 | 5/1990 |
| DE | 1 195 990 | 7/1962 |
| DE | 90 01 285.2 | 8/1990 |
| FR | 2 556 421 | 6/1985 |
| GB | 601327 | 5/1948 |
| GB | 611794 | 11/1948 |
| GB | 1066740 | 4/1967 |

* cited by examiner

*Primary Examiner*—Robert J. Sandy
(74) *Attorney, Agent, or Firm*—Barnes & Thornburg LLP

(57) ABSTRACT

A web adjuster for use with a web. A clamping member and a bearing member are mounted to a web adjuster frame and movable relative to the frame about a common axis. The web extends at least partially around the bearing member. Applying tension to the web moves the clamping member toward a web stop on the frame to trap the web between the clamping member and the web stop.

23 Claims, 4 Drawing Sheets

WEB ADJUSTER DEVICE

This application claims the benefit of and priority to U.S. Provisional Patent Application No. 60/448,047, filed 17 Feb. 2003.

BACKGROUND AND SUMMARY OF THE INVENTION

This invention relates generally to adjusters configured to adjustably control tension in a web, belt or strap, and more specifically to such adjusters configured to engage, stop or impede movement of the web in one direction of web travel while allowing relatively free travel of the web in the opposite direction of web travel.

It is known to attach conventional seat belt buckles and tongues to webs having their respective opposite ends fixedly mounted to a frame. For example, the respective opposite ends may be mounted to a platform such as for example a gurney or stretcher used to transport a patient or occupant. In order to allow use by different size occupants, the web is adjustably movable with respect to either the buckle or tongue. A web adjuster may be utilized to allow for the rapid sizing, locking and unlocking of the web. In the event the patient's body fluids contact the stretcher and components including the web, then the same must be cleansed and disinfected before reuse. As a result, the web utilized may be provided with a plastic coating to facilitate the cleansing thereof. One known pertinent prior art is commonly owned U.S. Pat. No. 5,311,653, the disclosure of which is incorporated herein by reference and attached hereto. So too, the web may be of a fluorescent color so that it is easily seen and so that body fluids or other contaminants on the web may be more readily detected.

It is desirable to provide a web adjuster device configured to engage the web in one direction of web travel while allowing travel of the web in the opposite direction of web travel, even if the web is coated by for example plastic or other pathogen resistant coating thereby presenting a surface having frictional characteristics that vary, depending on if it is dry or wet respectively, from being relatively resistant to travel through the web adjuster device to being relatively resistant to gripping by the web device. In other words, the web may vary from being relatively sticky and resistant to travel relative to the adjuster to being relatively slick (as when wet) and disposed to travel relative to the adjuster.

The present invention comprises one or more of the following features or combinations thereof. A web adjuster device comprising a webbing guide or frame defining a first web engaging surface or web stop. The frame may further comprise a pair of spaced apart side walls, with the first web engaging surface extending transversely therebetween and substantially perpendicular thereto. An elongate member such as a pin may be mounted to the frame between the pair of side walls. A bearing member may be mounted to the frame between the pair of side walls and may fit over the pin. The bearing member may have either a smooth or an irregular surface such as ridges, ribbing, or knurling, and may either be solid or be broken up by intervening apertures. The bearing member may be movable about a central longitudinal axis extending through said mounted bearing member. Alternatively, the bearing member need not be movable. A web clamping member may be movably mounted to the frame between the pair of side walls and may define a second web engaging surface and a third web engaging surface separate from the second web engaging surface. The clamping member may be configured to move about the longitudinal axis. In the event that the bearing member is not movable, it may be integrally connected with or form a monolithic structure with the clamping member. A bias member such as a spring may be disposed between the frame and the clamping member in order to urge the clamping member toward the first web engaging surface or web stop. The bearing member may extend radially beyond the web clamping member. The webbing guide or frame may be configured to receive a web extending between the side walls, at least partially around said bearing member, and between the first and second web engaging surfaces and in contact with the third web engaging surface. The third web engaging surface may be responsive to a first direction of web travel through the device to urge the second web engaging surface toward the first web engaging surface, and unresponsive to a second opposite direction of web travel through the device to allow the first and second web engaging surfaces to move apart from one another. The web adjuster device may be an in-line adjuster or rigidly attached to a platform. The web adjuster device may also be equipped or formed with a coupling portion such as for example and without limitation a tongue or a buckle. A platform may be equipped with one or more of the web adjuster devices. Each of the components of the web adjuster device may be formed from a suitable rigid, semi-rigid, or non-rigid metallic, nonmetallic or composite material such as for example steel, aluminum, zinc or other metal alloy, plastic resin, polymer, nylon, or the like without limitation, and/or from any suitable flexible material such as for example rubber, or the like, and manufactured in any method suitable to the materials being used.

These and other features of the present invention will become more apparent from the following description of the illustrative embodiments.

DETAILED DESCRIPTION OF THE DRAWINGS

Figure 1:
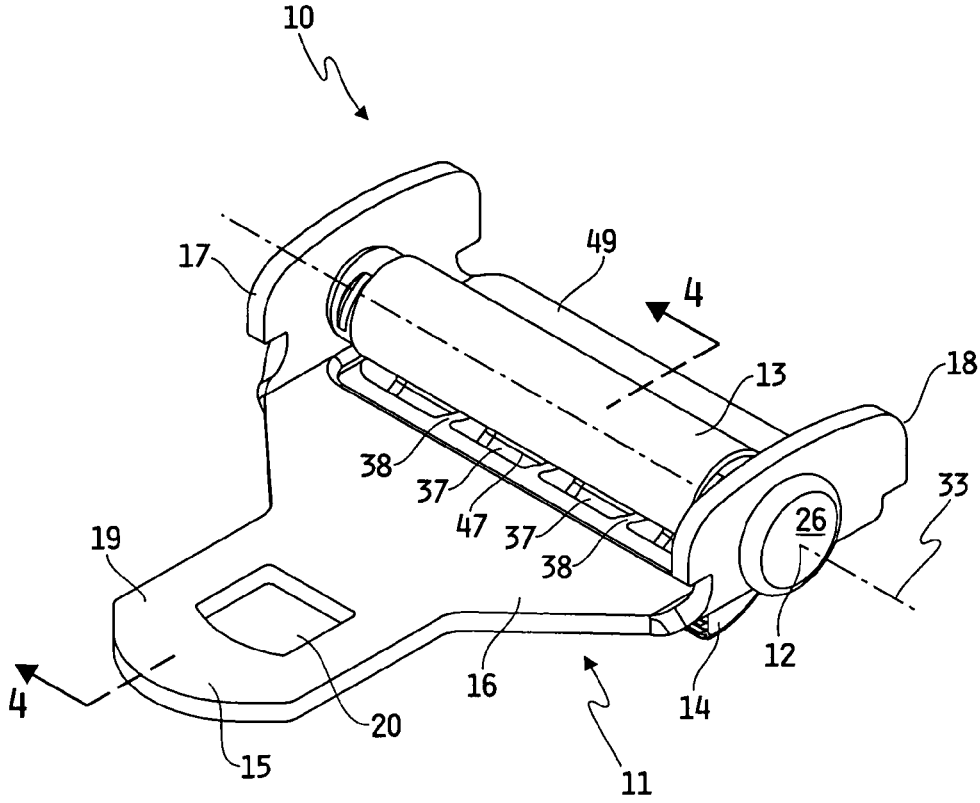
FIG. 1 is a perspective view of one illustrative embodiment of a web adjuster device according to the present invention
Figure 3:
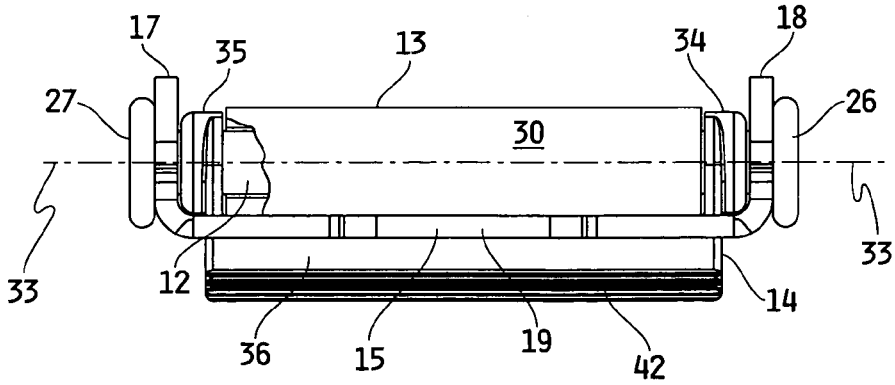
FIG. 3 is a front elevation of the illustrative web adjuster device illustrated in FIGS. 1 and 2.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIGS. 1–4B, one illustrative embodiment 10 of a web adjuster is shown. Web adjuster device 10 generally comprises a frame or webbing guide 11, a bearing member or sleeve 13, and a web clamping member 14. The sleeve 13 and the web clamping member 14 are each transversely and movably mounted to the frame 11 as will be described herein below.

Figure 2:
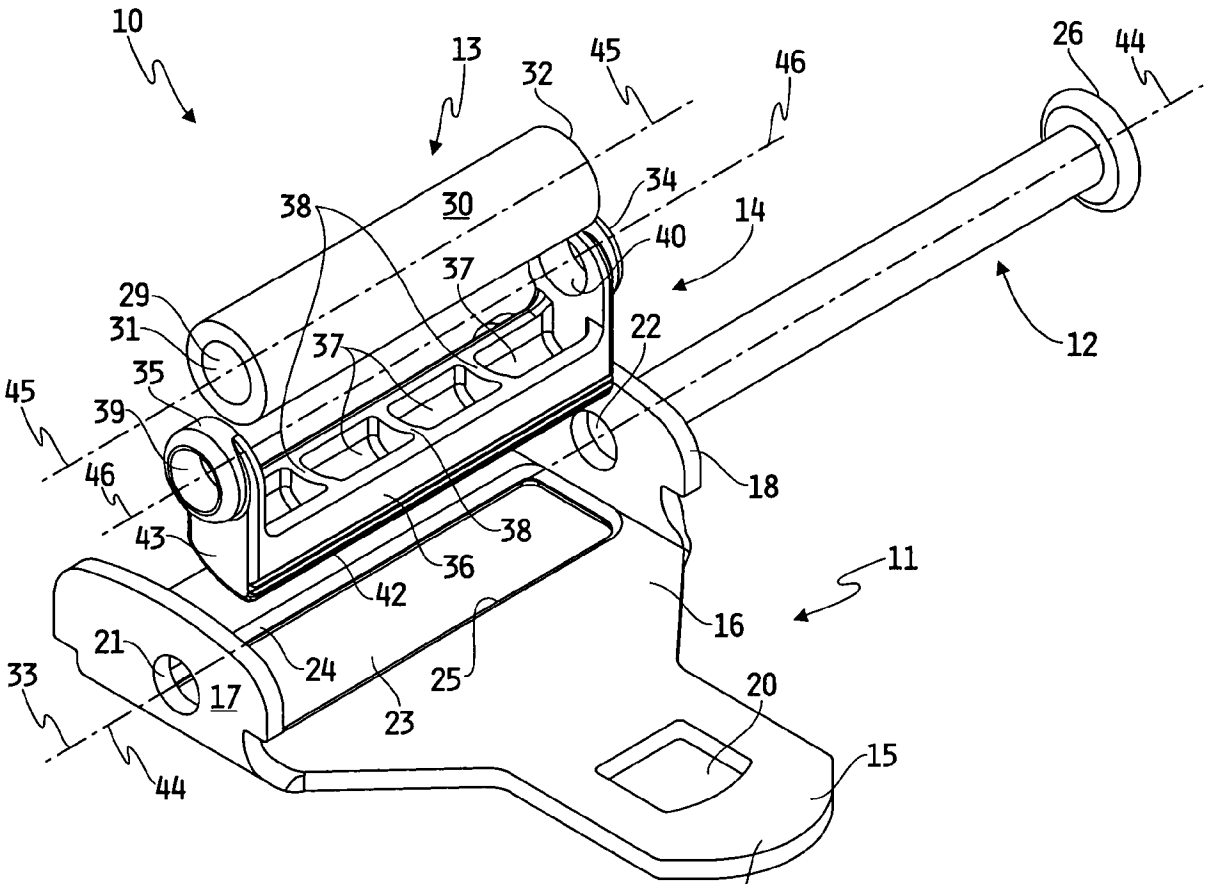
FIG. 2 is an exploded view of the illustrative web adjuster device of FIG. 1 illustrating various components thereof.

Illustratively, the frame 11 is monolithic and comprises a generally rectangular guide portion 16 and a coupling portion 15 having a generally angling base extending outwardly towards a generally elongated seat belt tongue 19. Coupling portions other than a tongue 19, such as for example and without limitation a buckle, are also contemplated. The conventional seat belt tongue 19 defines an aperture 20 configured to releasably and lockingly engage a conventional belt buckle. The coupling portion 15 extends away from the guide portion 16 and may do so either in a co-planar or in a generally upwardly sloping fashion such that the tongue 19 lies in a plane that is illustratively disposed above and at an oblique to a plane defined by the horizontal portions of guide portion 16. In the illustrative embodiments depicted in the drawings, the horizontal portions of coupling portion 15 and guide portion 16 are substantially co-planar. The guide portion 16 defines a web aperture 23 extending transversely of the frame 11 between and generally perpendicular to a pair of spaced apart and generally upstanding side walls 17 and 18 which define respective holes 21 and 22 therethrough. As best seen in FIG. 2, the web aperture 23 defines a first edge or first web engaging surface or web stop 24 and a second edge 25 generally parallel to and spaced apart from first web engaging surface 24, each extending generally perpendicular to and transversely between the walls 17, 18. It is desirable to form the frame 11 from a suitable material. An example of one suitable material for forming frame 11 is steel or other metal composition, although the present invention contemplates forming frame 11 from any suitable rigid, semi-rigid or flexible material, whether metallic, non-metallic or composite material such as for example aluminum, zinc, plastic, resin and the like as will be further explained below. It will be understood that the frame 11 need not be of monolithic construction.

A web 50 for use with the web adjuster device 10 illustratively may be colored and/or fluorescent and may be made from any suitable natural or synthetic material such as for example fabric. It may also be coated to allow for easy cleansing. Such a coating may be for example and without limitation a plastic, such as, urethane. The web itself, or the coating, may make the web relatively stiff or sticky and therefore resistant to travel through the web adjuster device 10. Therefore, a movable bearing or rolling member may be used to facilitate movement through the web adjuster device as will be explained. Illustratively, as seen in FIG. 2, bearing member or sleeve 13 has a generally cylindrical cross-section and defines a bore 29 extending longitudinally therethrough between opposing holes 31 and 32 of the sleeve 13. The sleeve 13, which has a central longitudinal axis 45 through the bore 29, is illustratively formed of a plastic material such as for example Delrin, although it will be understood that it may be fashioned of any suitable rigid, semi-rigid, or flexible, whether metallic, non-metallic or composite material such as for example aluminum, zinc, plastic, resin and the like as will be further explained below. The surface 30 of the sleeve 13 is generally smooth, although it need not be. For example, it may be configured with ridges, serrations, knurling and the like. Also, although the illustrative embodiment has a generally solid and unbroken surface, such need not be the case.

Figure 4A:
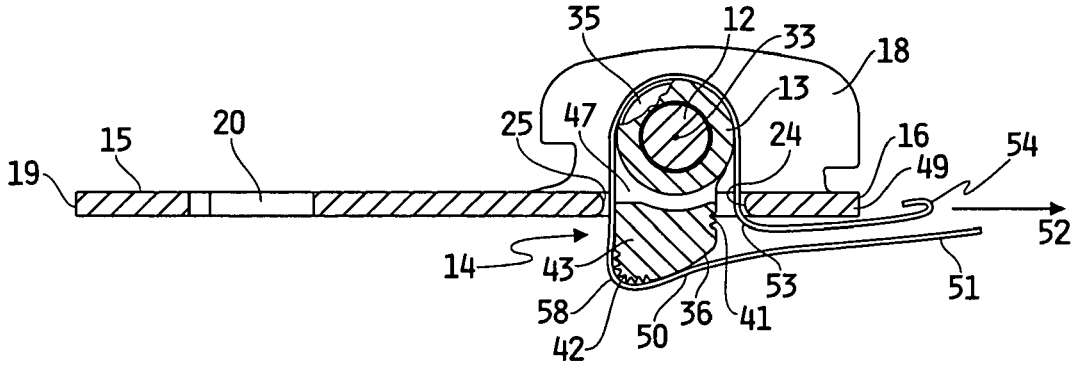
FIG. 4A is a cross-sectional view of the illustrative web adjuster device of FIG. 1, viewed generally along section line 4—4 illustrating the device in an open or unlocked position to allow travel of a web therethrough.
Figure 4B:
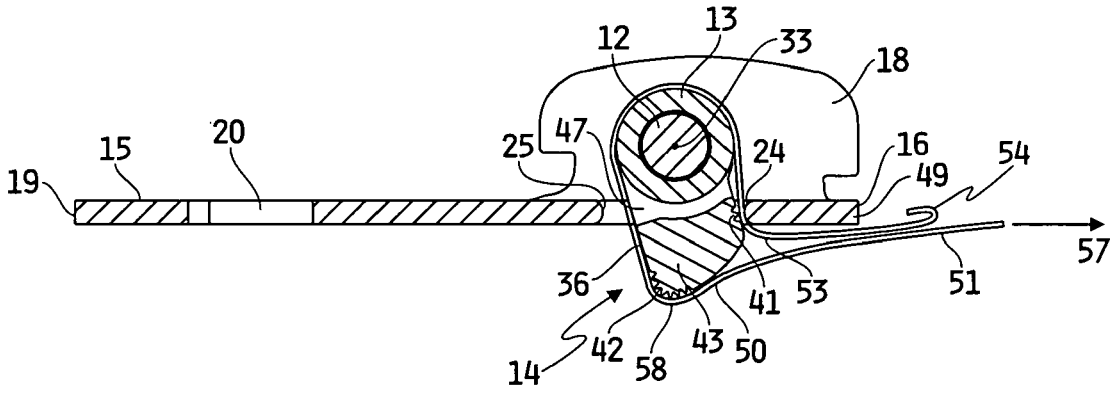
FIG. 4B is a cross-sectional view of the illustrative web adjuster device of FIG. 1, viewed generally along section line 4—4 illustrating the device in a closed or locked position trapping the web therein.

Web clamping member 14, which is an example of one of a number of suitable means for clamping a web, illustratively comprises an elongated and generally wedge-shaped or arcuate web engaging member 43, although other shapes, both regular and irregular, for example including without limitation triangular, quadrilateral, polygonal, or cylindrical, capable of providing the proper amount of leverage or means for clamping to engage, clamp or stop the movement of the web relative to the frame 11, fall within the scope of the invention. Extending upwardly at each end of the web engaging member 43 is a pair of spaced apart ears 34 and 35, each defining therethrough a respective hole 40 and 39. A central longitudinal axis 46 runs through holes 39, 40. As best seen in FIGS. 4A and 4B, web engaging member 43 comprises second and third web engaging surfaces 41 and 42, which illustratively have serrated or ribbed web engaging profiles, with any desired number of serrations or ribs extending generally the longitudinal length of the engaging member 43 to facilitate gripping of a web, belt or harness, although it will be appreciated that web engaging surfaces 41 and 42 may alternatively be enhanced with any other desired web engaging profile and/or material adapted to facilitate engagement of a web in contact therewith. Examples of such profiles and/or material include, but are not limited to, a knurled surface, a toothed surface, a sheath of a suitable web engaging material disposed on surface 41 and/or 42, and the like. Alternatively, web engaging surfaces 41 and/or 42 may be generally smooth without adversely affecting the operation of device 10 as described in greater detail herein. As further illustrated in FIGS. 2, 3, 4A and 4B, it is desirable to configure further web engaging surfaces 36 as smooth surfaces for facilitating smooth travel of a web over the surfaces 36, although the present invention contemplates providing such surfaces 36 with any desired profile. Although the web engaging member 43 may have a solid inner construction, illustratively it has a number of cavities 37 separated by walls 38 along its longitudinal length. While the web clamping member 14 is illustratively of monolithic construction, it need not be, and although it is illustratively made of steel, it may be formed of any suitable rigid, semi-rigid or flexible material, whether metallic, non-metallic or composite material such as for example aluminum, zinc, plastic, resin and the like as will be further explained below.

Referring to FIG. 2, sleeve 13 and web clamping member 14 are movably attached to frame 11 via an elongate member, for example a bar or pin 12, having a central longitudinal axis 44. Pin 12 may be solid and may be made from steel or other suitable resilient or rigid material. Illustratively, pin 12 extends through holes 21, 22, 31, 32, 39, 40 when the holes are suitably aligned as when the respective axes 44, 45, 46 are generally aligned, to movably mount the sleeve 13 and web clamping member 14 to frame 11 between the pair of side walls 17, 18. Pin 12, which may have a flared end 26, may be retained at the other end, either rigidly or movably, by any suitable means, for example, by press fit, screw, rivet, solder, and the like.

When thus mounted, the sleeve 13 and web clamping member 14 move about common central axis 33, which is coaxial with central axes 44, 45 and 46 in the assembled web adjuster device 10 and which extends transversely between the side walls 17, 18. More specifically, web clamping member 14 is sized such that the longitudinal distance between ears 34, 35 disposes the ears 34, 35 to fit between walls 17 and 18 and respectively adjacent thereto. Sleeve 13 in turn is sized to fit between ears 34, 35 and to be straddled thereby. Thus, illustratively, the sleeve 13 has a longitudinal length slightly shorter than the distance between ears 34, 35 along axis 46. Illustratively, the bearing member or sleeve 13 extends radially beyond the web engaging member 43. The length of the ears 34, 35 is such that when mounted as just described a void 47 is defined between the sleeve 13 and the web clamping member 14 along the longitudinal length between the ears 34, 35 as best seen in FIGS. 1, 4A and 4B. While the length of void 47 is generally defined by the lateral distance between the ears, its width is such that the distance between the engaging member 43 and the sleeve will not impede movement of the sleeve relative to the pin 12. The void 47 might even be eliminated altogether if the friction between the web and the elongate member 12 were such that the rotating bearing member or sleeve 13 could be eliminated. The holes 21, 22, 31, 32, 39, 40 each define an inner diameter sized to receive the pin 12 therethrough and to allow movement of each of pin 12, sleeve 13, and web clamping member 14 about axis 33. Those skilled in the art will appreciate that pin 12 could also be immovably mounted to frame 11. It will further be appreciated that web clamping member 14 may be otherwise movably mounted to frame 11 via suitable means. For example, ears 34, 35 could be positioned adjacent to the outside of side walls 17, 18, rather than the illustrated positioning inside of walls 17,18, and adjacent to the sleeve 13. Similarly, pin 12 could be eliminated altogether if other suitable mounting means were used. For example, the sleeve 13 could have flared ends configured to movably mate with the ears 34, 35, or, if the ears are mounted on the outside of side walls 17, 18, then directly with the sidewalls. While the sleeve 13 and the web clamping member 14 may simultaneously move about the pin, they may also each move independently of the other. Thus, there may be times, for example, when the sleeve 13 is in motion and the web clamping member 14 is not, and vice versa.

As illustrated in FIGS. 4A and 4B, the web adjuster device 10 is adapted to receive a length of web 50 extending between walls 17 and 18 of frame 11, and through aperture 23 between first and second web engaging surfaces 24 and 41, and proceeding at least partially about and generally in contact with the surface of sleeve 13 and continuing around and generally proximate to or in contact with third web engaging surface 42. Illustratively, third web engaging surface 42 is formed on a protrusion of web engaging member 43, generally opposite to second web engaging surface 41. Web adjuster device 10 is configured generally to allow movement or travel of web 50 therethrough along a second web travel direction 52, and under certain circumstances generally to inhibit travel of web 50 therethrough along a first web travel direction 57 by engaging, trapping, clamping or locking a portion of web 50 between first web engaging surface or stop 24 and second web engaging surface or locking portion 41. For example, referring specifically to FIG. 4A, web adjuster device 10 is configured to allow generally free travel or movement of web 50 relative to the frame along the second web travel direction indicated by the movement of web end 54 in the direction of arrow 52, no matter the orientation of the web 50 relative to the frame, and generally for so long as there is any slack in the web 50. Thus, when web 50 travels in the second direction 52 in a generally clockwise manner about axis 33 in FIG. 4A, generally no locking takes place so long as there is slack in the web 50 and the web 50 may therefore travel relatively freely along second travel direction 52, guided by sidewalls 17 and 18 and in general contact with the surface of the sleeve 13 and perhaps with the clamping member 14. During this movement or travel, depending on the friction between web 50 and the sleeve 13, web 50 may glide or slide over the sleeve 13 without causing the sleeve to move or rotate. Generally, though, the friction will be such that the bearing member or sleeve 13 will move about the pin as the web 50 travels through the web adjuster device. When sufficient slack is taken out of the web 50, however, the clamping member 14 will halt the movement of the web 50 as will be described below. It will be appreciated that movement of the web 50 in the first direction 57, generally counter-clockwise about axis 33 in FIG. 4A, is also relatively free of locking by the web clamping member 14 so long as the web 50 in the vicinity or proximity of engaging surface 42 is at an angle of inclination of greater than about 30 degrees away from engaging surface 24 relative to the frame 11 such that the web engaging member 43 is not urged into the locked or locking position depicted in FIG. 4B and as will now be described. It will be appreciated that the above angle of inclination is illustrative only and could be any angle by design as is known to those skilled in the art.

Referring now to FIG. 4B, web adjuster device 10 is configured to check or inhibit and eventually to stop travel of web 50 along the first web travel direction 57, illustratively counter-clockwise, opposite to the second web travel direction 52, illustratively clockwise, as indicated for example by applying a force or tension to, such as by pulling, web portion 51 in the direction of arrow 57 as illustrated. When such a tension or force is applied in this first travel direction 57 such that web 50 is urged against and applies a force to third web engaging surface 42 in such a manner as to force web clamping member 14 generally counterclockwise about axis 33 and toward web engaging surface or stop 24, web engaging surface 41 is urged toward web engaging surface 24 and traps or clamps a portion 53 of web 50 therebetween as shown. In this locked position, web 50 is locked to device 10 and is therefore inhibited from traveling along the first web travel direction. Any further force applied to web 50 in the first web travel direction serves to further urge or force second web engaging surface or locking portion 41 of web clamping member 14 toward web engaging surface or stop 24, thereby increasing the grip on web 50 therebetween. As noted above, however, if a more downwardly force is applied to end 51, rather than the depicted force generally parallel to the plane of the frame 11, then the web engaging member 43 will not be urged into the locked or locking position and the web 50 will be able to move. Movement of the web 50 may also be facilitated by moving the frame 11 itself into a position relative to the web 50, as will be described below, that allows the clamping member 14 and the stop 24 to move apart, to an unlocked or unengaged position, thereby freeing the web 50 from therebetween.

It will be appreciated that applying a force to web portion 54, as by pulling, in the second travel direction 52 until the slack (FIG. 4A) is taken out of the web 50 will bring the lower web portions 51, 58 into an orientation generally parallel to the frame 11 and will generate an opposing force acting in the first travel direction 57 to urge web portion 58 against the web engaging member 43. Web portion 58 acting against the web engaging member in the first travel direction 57 urges the web clamping member 14 in a counter-clockwise direction about the central axis 33 to move the web engaging member 43 toward web engaging surface 24 thereby to trap the web 50 between the web engaging surfaces 41 and 24 as described above and as depicted in FIG. 4B. When it is desirable to allow free or relatively free travel of web 50 through device 10 along the first direction 57 of web travel, handle or end portion 49 of frame 11 may be manually forced away from web portion 51 at a suitable angle of inclination illustratively in the range of greater than about 30 degrees thereby moving apart or allowing to move apart web engaging surface 24 and web engaging surface 41. As noted, those skilled in the art could design other embodiments to encompass any other suitable angle of inclination, including angles less than 30 degrees. So too, the web adjuster device could be fashioned with a more pronounced handle. End portion or handle 49 may be forced away by the direct application of force thereto, or by indirect application of force as by lifting the end portion 54 of web 50 away from portion 51. In the illustrated embodiment, for example, movement of end portion 49 away from web portion 51 causes or allows the separation of web engaging surfaces 24 and 41, thereby permitting free travel of web 50 through device 10 along either the first 57 or second direction 52 of web travel to the extent allowed by the length of web portions 51, 54 on either side of the device 10 and as described above. This movement of the handle or end portion 49 may be accomplished for example by a user applying a force to the end portion in a direction upwardly away from the web portion 51. In this illustrative embodiment, web portion 51 represents a tension end of the web 50, and web portion 54 represents a free end of the web 50. It should be noted that the web adjuster device 10 could be designed such that the tension end 51 and the free end 54 are reversed. In such a case, a clockwise direction of travel about the central axis 33 could result in clamping the web 50 in the locked position, and an opposite counterclockwise direction of travel would result in relatively free travel or unlocked position.

Thus, in operation, tongue 19 may be lockingly engaged with a buckle (not shown) which in turn may be attached to a second web (not shown) attached to a platform, such as for example and without limitation, a bed, chair, gurney, stretcher, backboard, litter or other device or structure. End portion 54 may then be grasped and pulled in the direction of arrow 52, which results in the web 50 moving in a clockwise direction about the axis 33 with the web portion 54 proceeding away from the device 10 in a manner generally parallel to the plane of the guide portion 16, although the direction of pull could also be generally upwardly away from the plane of the guide portion 16 in order to use the frame 11 for purchase to further tighten or "cinch" the web 50. In the event slack exists in the web 50, then web 50 will travel over the bearing member or sleeve 13, which may rotate in a generally clockwise direction about axis 33. It will be appreciated however, that sleeve 13 need not move and need not even be movable as long as it is configured to aid the flow of the web 50 thereover. For example, in the illustrative embodiment the surface 30 of the bearing member 13 is smooth, and in such a case, illustratively, the bearing 13 need not move. For example, even if the bearing member 13 is movable, the web 50 may simply slide over the bearing member 13 with insufficient friction to move the bearing member 13. Therefore, because the bearing member 13 need not be movable, it is within the scope of the present invention for the bearing member 13 and the web engaging member 14 to be of monolithic construction.

In any event, as the tension web portion 51 generates a force acting in first direction 57, the web 50 acts against third web engaging surface 42 thereby urging engaging member 43 toward web engaging surface 24 and trapping the web 50 in the vicinity of web portion 53 therebetween as described above. Such a force in the first direction 57 may be generated directly by pulling web portion 51 in first direction 57, or by tightening the web 50 by pulling web portion 54 in second direction 52 until an opposite force is generated between the mounted end of tension end 51 and the free end 54 in the first direction 57. By positioning web 50 generally in an angle of inclination of greater than about 30 degrees relative to the plane of the guide portion 16, or other suitable angle by design, web engaging surfaces 24 and 41 are separable or are separated a sufficient amount to unlock or release the web 50 from between the engaging surfaces 24 and 41 thereby allowing the web 50 to move relatively freely through the device 10. Thus, in order to unlock the web 50 from the adjuster 10 shown in FIG. 4B, end 49 of frame 11 may be directly moved upwardly away from web 50 to rotate frame 11 and guide portion 16 about the longitudinal axis 33 while maintaining the position of web 50 until the web is generally disposed in the range of the angle of inclination relative to the bottom surface of the guide portion 16 of frame 11. Alternatively, web portion 54 may be urged upwardly away from web portion 51, as by for example lifting, thereby urging the frame 11 to rotate about the axis 33 and pin 12 and again separating or allowing the separation of the first and second web engaging surfaces 24, 41. It will be appreciated that release aids, such as equipping the frame 11 with a more pronounced handle than the handle represented by end 49 itself to ease the manipulation of the end 49 may be used. Also, by disposing the coupling portion 15 in a different plane than the plane of the frame 16, as described above, the operable engagement of the tongue with a buckle, and the locking and unlocking of the web adjuster device may be optimized as known to those in the art. In addition, the web 50 may be released or unlocked through the introduction of slack as by for example pushing free end 54 in a direction opposite to second direction 52 to urge web 50 in a counterclockwise direction about the axis 33 with reference to FIG. 4B, or as by releasing the tension end 51 from its anchor position on the gurney, cart, cot, bed, etc., and thereafter moving end 51 toward coupling portion 15 to urge web 50 in a clockwise direction about axis 33.

Figure 5:
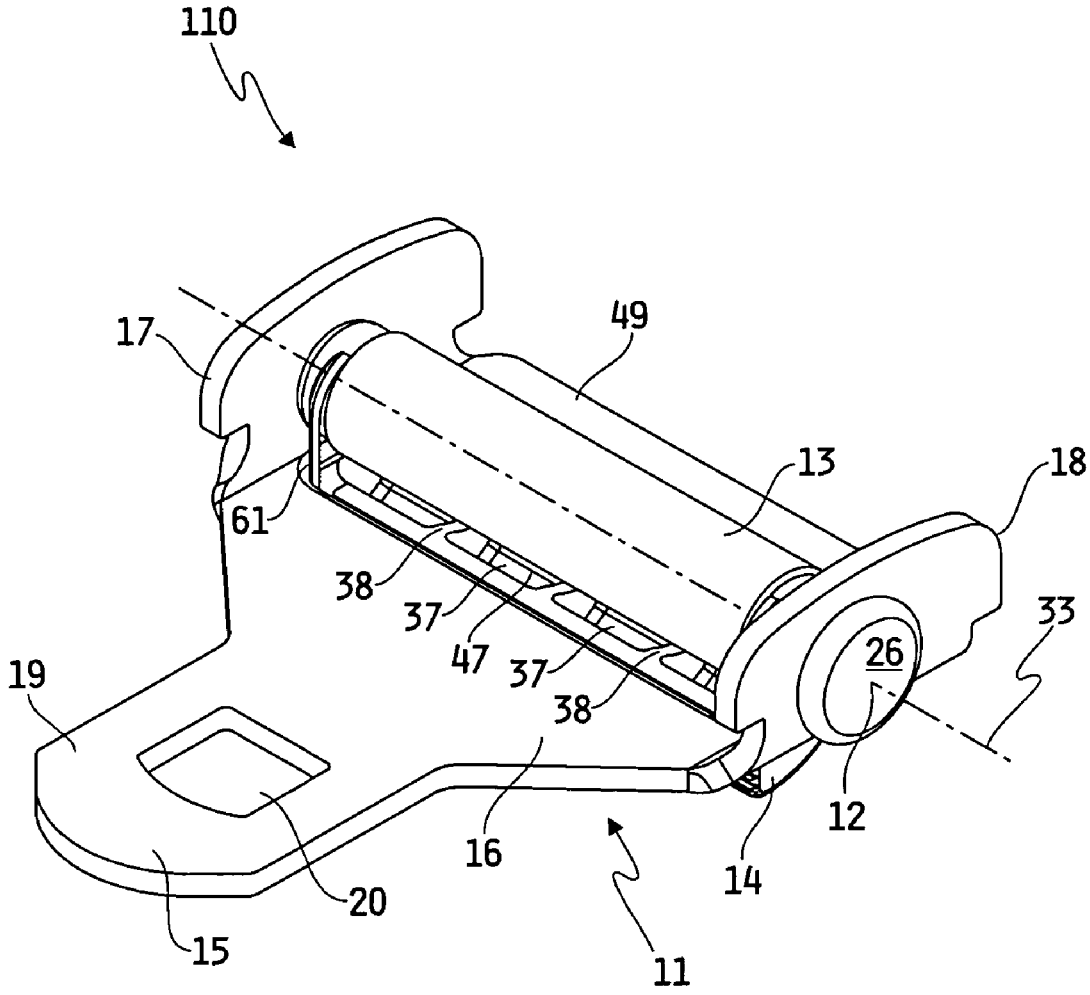
FIG. 5 is a perspective view of an alternate illustrative web adjuster embodiment further comprising a web clamping member biasing member.

Referring now to FIG. 5, an alternate embodiment 110 is shown. Web adjuster device 110 is structurally similar and functionally identical to web adjuster device 10 just described with respect to FIGS. 1-4B, and the foregoing discussion relating to web adjuster device 10 applies directly to device 110 the only difference being the addition of a biasing member 61, such as a spring, to aid in urging the web clamping member toward the web engaging surface 24 in a manner known to those skilled in the art.

As noted, the components of web adjuster device 10, 110 may be made from any suitable metallic, non-metallic, or composite material possessing the suitable rigid, semi-rigid, or flexible characteristics desired. In the illustrative embodiments, for example, frame 11 and web clamping member 14 may be formed from a rigid polymer, although the present invention contemplates that frame 11 and/or web clamping member 14 may alternatively be formed from any suitable rigid material such as steel or other metal alloy, plastic resin, nylon, or the like, and/or from any suitable flexible material such as rubber, or the like. In general, the profiles of web engaging surfaces 24, 41 and 42 and of web engaging member 43 respectively may be variously configured, taking into account the material composition of frame 11 and web clamping member 14 and the web load force capacities thereof as well as web integrity concerns. For example, in cases where frame 11 and web clamping member 14 are both formed of a polymer material, it may be desirable to provide web engaging surfaces 24, 41 and 42 with web engaging profiles as illustrated to share the web load force under web locking conditions between frame 11 and web clamping member 14. With such materials, damage to web 50 due to repeated gripping between web engaging surfaces 24 and 41 will likely be minimal as compared with metal components, and providing both web engaging surfaces 24 and 41 with web engaging profiles will therefore generally not be a concern. However, in cases where both frame 11 and web clamping member 14 are formed of steel or other metal alloy, potential web damage due to repeated gripping between surfaces 24 and 41 may be a greater concern, and load sharing between frame 11 and web clamping member 14 less of a concern. In such cases, it may accordingly be desirable to configure only one of the surfaces 24 and 41 with a web engaging profile while configuring the remaining surface with a smooth profile. With this configuration, more web load force will typically be borne by the component having a web engaging surface, yet web damage will be minimized. The present invention accordingly contemplates myriad combinations of surface profiles for web engaging surfaces 24 and 41, and any such combinations are intended to fall within the scope of the present invention.

The instant invention further contemplates use with conventional webs or with stiff but uncoated webs. In addition, the invention would encompass uses other than with the adjust tongue as just described. For example, the invention would contemplate use as an in-line web adjuster, or an adjuster integrated with a buckle, or even a rigidly mounted adjuster, alone or in combination with other types of adjusters such as disclosed in commonly owned U.S. patent application Ser. Nos. 10/206,660 filed 26 Jul. 2002 by Woodard et al., and 10/205,258 filed 25 Jul. 2002 by Anthony et al., the disclosures of which are incorporated herein by reference. While the use of two webs, one web 50 proceeding through the web adjuster device 10, 110 having a tongue coupling portion and attached at its tension end 51 to the desired platform and the other web (not shown) attached to the platform and having a buckle portion has been described, it is also contemplated that a single web, having a buckle at one end and a tongue at the opposite end, could be used in conjunction with the web adjuster device 10, 110. In such a case, the single web could be wrapped around the desired platform and may even be attached thereto in a manner known to those skilled in the art. No matter whether a single web is used, or two webs each attached to the platform, or some other combination of webs, the web adjuster device 10, 110 could have a coupling portion that is either a tongue, a buckle, or some other coupler. Moreover, a combination of web adjuster devices 10, 110 could be used, such as for example where one device 10, 110 has a tongue and another has a buckle.

Although the invention has been described in detail with reference to certain embodiments, it should be understood that the invention is not limited to the disclosed embodiments. Rather, the present invention covers variations, modifications and equivalent structures that exist within the scope and spirit of the invention and such are desired to be protected.

What is claimed is:

1. A web adjuster device comprising:

a frame comprising a pair of spaced apart side walls, and a first web engaging surface extending transversely between the side walls;

a bearing member movably mounted to the frame between the pair of sidewalls;

a web clamping member movably mounted to the frame between the pair of side walls, the web clamping member defining a second web engaging surface and a third web engaging surface separate from the second web engaging surface;

wherein the frame is configured to receive a web extending between the side walls, at least partially around the bearing member and the web clamping member, and between the first and second web engaging surfaces and adjacent to or in contact with the third web engaging surface; and wherein the third web engaging surface is configured to be responsive to a first direction of web travel through the web adjuster device to urge the second web engaging surface toward the first web engaging surface to trap the web therebetween.

2. The web adjuster device of claim 1 further comprising a central axis extending transversely between the side walls and wherein the web clamping member and the bearing member each move about the central axis.

3. The web adjuster device of claim 2 wherein the web clamping member rotates about the central axis.

4. The web adjuster device of claim 3 wherein the bearing member rotates about the central axis.

5. The web adjuster of claim 4 further comprising an elongate member mounted to the frame between the pair of sidewalls, the elongate member including a longitudinal axis that is coaxial with the central axis and wherein the elongate member mounts the web clamping member and the bearing member to the frame.

6. The web adjuster of claim 5 wherein the bearing member extends radially beyond the web clamping member.

7. The web adjuster device of claim 5 wherein the first and second web engaging surfaces are configured to grip a web extending therebetween as the second web engaging surface of the web clamping member is forced toward the first web engaging surface of the frame.

8. The web adjuster device of claim 7 wherein the web clamping member is generally wedge shaped and includes a protrusion extending opposite the second web engaging surface, the protrusion defining the third web engaging surface of the web clamping member.

9. The web adjuster device of claim 7 wherein applying a force to the web in the first direction forces the web into contact with the third web engaging surface to rotate the web clamping member toward the first web engaging surface to trap the web between the first web engaging surface and the second web engaging surface.

10. The web adjuster device of claim 7 wherein movement of the web in a second direction generally opposite the first direction allows the first and second web engaging surfaces to move away from each other to allow the web to move relatively freely through the web adjuster device relative to the frame.

11. The web adjuster device of claim 7 wherein the frame includes a handle portion configured for manual manipulation of the frame in order to separate from one another the first and second web engaging surfaces to allow movement of the web relative to the frame.

12. The web adjuster device of claim 7 wherein the web adjuster device is rigidly mounted to a platform.

13. The web adjuster device of claim 7 further comprising a coupling portion extending outwardly from the frame.

14. The web adjuster device of claim 13 wherein the coupling portion comprises a buckle configured to receive a tongue.

15. The web adjuster device of claim 13 wherein the coupling portion comprises a tongue configured to mate with a buckle.

16. The web adjuster device of claim 15 wherein the frame lies in a first plane and the tongue extends outwardly from the frame in a second plane.

17. The web adjuster device of claim 7 further comprising a biasing mechanism mounted in contact with the web clamping member and the frame, the biasing mechanism biasing the second web engaging surface of the web clamping member toward the first web engaging surface of the frame.

18. A web adjuster device comprising:

a frame with a pair of spaced apart side walls and having a coupling portion and a web stop extending across the frame;

an elongate member mounted between the spaced apart side walls;

a bearing member movably mounted on the elongate member which extends through the bearing member, the bearing member having a longitudinal axis of rotation;

means for clamping movably mounted to the frame;

a web extending at least partially around each of the bearing member and the means for clamping and passing between the means for clamping and the web stop;

the web clamping member responsive to a first direction of travel of the web relative to the frame to urge the means for clamping toward the web stop to trap the web therebetween.

19. The web adjuster device of claim 18 wherein the web is coated to facilitate cleansing of the web.

20. The web adjuster device of claim 19 wherein the web is fluorescent.

21. A web adjuster device configured to clamp a web having a free end and a tension end when tension is applied to the tension end of the webbing, the adjuster device comprising:

a webbing guide;

a pin mounted to the webbing guide;

a web clamping member mounted by the pin to the webbing guide and movable with respect to the webbing guide;

a bearing member mounted by the pin to the webbing guide and movable with respect to the webbing guide, the bearing member extending radially beyond the web clamping member;

a coupling portion extending from the webbing guide;

a locking portion on the web clamping member which in a locked position clamps the webbing between the locking portion and the webbing guide to prevent movement of the webbing through the adjuster when tension is applied to the tension end;

a release actuator to cause movement of the webbing guide relative to the web clamping member to separate the webbing guide and the web clamping member wherein the webbing is released to allow it to move in either direction through the adjuster device; and a projection on said web clamping member that abuts against the webbing between the locking portion and the tension end thereof so that the webbing when tensioned exerts a force against the projection which urges or causes rotation of the clamping element in a direction that holds or moves the locking portion in or into a locked position.

22. A web adjuster device comprising:

a frame comprising a pair of spaced apart side walls, and a first web engaging surface extending transversely between the side walls;

a web clamping member movably mounted to the frame between the pair of side walls, the web clamping member having an external peripheral surface defining a second web engaging surface and a third web engaging surface separate from the second web engaging surface;

wherein the frame is configured to receive a web extending between the side walls, at least partially around the web clamping member, and between the first and second web engaging surfaces and adjacent to or in contact with the third web engaging surface; and wherein the third web engaging surface is configured to be responsive to a first direction of web travel through the web adjuster device to urge the second web engaging surface toward the first web engaging surface to trap the web therebetween.

23. A web adjuster device comprising:

a frame comprising a pair of spaced apart side walls, and a first web engaging surface extending transversely between the side walls;

a web clamping member mounted to the frame between the pair of side walls and fixed from linear movement relative to the sidewalls, the web clamping member defining a second web engaging surface and a third web engaging surface separate from the second web engaging surface;

wherein the frame is configured to receive a web extending between the side walls, at least partially around the web clamping member, and between the first and second web engaging surfaces and adjacent to or in contact with the third web engaging surface; and wherein the third web engaging surface is configured to be responsive to a first direction of web travel through the web adjuster device to urge the second web engaging surface toward the first web engaging surface to trap the web therebetween.

* * * * *